US008328389B2

(12) United States Patent
Wu

(10) Patent No.: US 8,328,389 B2
(45) **Date of Patent: *Dec. 11, 2012**

(54) LIGHT EMITTING DIODE DISPLAY

(75) Inventor: Eric Cheng Yuan Wu, Walnut, CA (US)

(73) Assignee: American Opto Plus Led Corporation, Pomona, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/372,331

(22) Filed: Feb. 13, 2012

(65) Prior Publication Data

US 2012/0140485 A1 Jun. 7, 2012

Related U.S. Application Data

(63) Continuation of application No. 12/269,846, filed on Nov. 12, 2008, now Pat. No. 8,136,960.

(51) Int. Cl.
*F21V 1/00* (2006.01)

(52) U.S. Cl. ..... 362/235; 362/311.01; 362/311.02; 313/512

(58) Field of Classification Search ..... 362/235–240, 362/311.01, 311.02; 313/510–512; 40/815.44, 40/815.45

See application file for complete search history.

(56) References Cited

U.S. PATENT DOCUMENTS

| | | | | |
|---|---|---|---|---|
| 1,998,857 | A | 4/1935 | Wolf | |
| 3,918,053 | A | 11/1975 | Towne et al. | |
| 4,146,883 | A | 3/1979 | Appeldorn et al. | |
| 4,843,280 | A | 6/1989 | Lumbard et al. | |
| 4,853,593 | A | 8/1989 | Stein | |
| 5,331,512 | A | 7/1994 | Orton | |
| 6,307,527 | B1 | 10/2001 | Youngquist et al. | |
| 6,806,506 | B2 | 10/2004 | Tsuji | |
| 6,829,852 | B1 | 12/2004 | Uehran | |
| 6,909,234 | B2 | 6/2005 | Chen | |
| 6,930,332 | B2 | 8/2005 | Hashimoto et al. | |
| 7,175,304 | B2 | 2/2007 | Wadia et al. | |
| 7,336,339 | B2 | 2/2008 | Ho | |
| 7,850,339 | B2 | 12/2010 | Wadia et al. | |
| 8,136,960 | B2 * | 3/2012 | Wu | 362/235 |

(Continued)

FOREIGN PATENT DOCUMENTS

EP 0 303 741 A1 2/1989

(Continued)

OTHER PUBLICATIONS

European Search Report from European Application No. 091753780.0 dated Jan. 7, 2010 in 6 pages.

*Primary Examiner* — John A Ward

(74) *Attorney, Agent, or Firm* — Knobbe, Martens, Olson & Bear LLP

(57) ABSTRACT

An LED display with a reduced thickness is described. In one embodiment, the LED display includes a second support plate between a front support plate and a back support plate. The second support plate enables the front support plate to be thinner than if the second support plate was not included. The second support plate increases the distance between an LED chip and a light exit surface thereby allowing the front support plate thickness to be reduced by about the thickness of the second support plate. In one embodiment, the second support plate allows the thickness of an LED display to be thinner. The second support plate adds structural integrity to a back support plate. Therefore, the back support plate can be thinner, and thickness of the LED display can be reduced.

20 Claims, 13 Drawing Sheets

U.S. PATENT DOCUMENTS

| | | | |
|---|---|---|---|
| 2003/0106247 | A1 | 6/2003 | Huang |
| 2003/0189830 | A1 | 10/2003 | Sugimoto et al. |
| 2006/0065957 | A1 | 3/2006 | Hanya |
| 2007/0127227 | A1 | 6/2007 | Osawa |
| 2011/0019412 | A1 | 1/2011 | Wu |

FOREIGN PATENT DOCUMENTS

| | | | |
|---|---|---|---|
| JP | 9 022259 | A | 1/1997 |
| JP | 11-167357 | | 6/1999 |

* cited by examiner

FIG. 7A
(prior art)
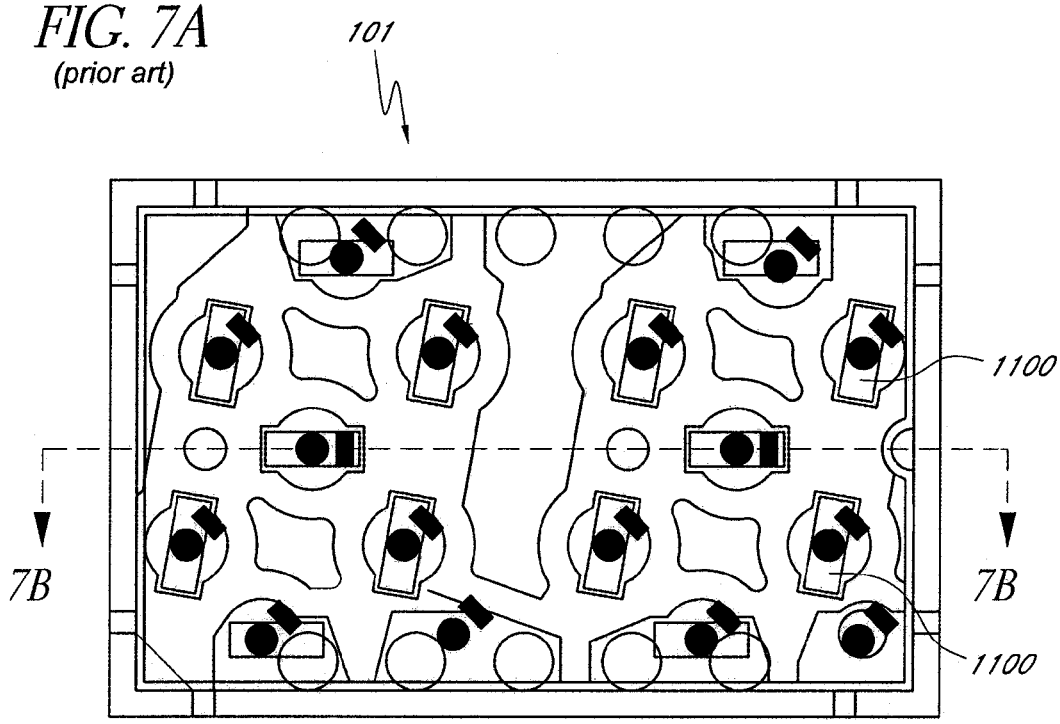
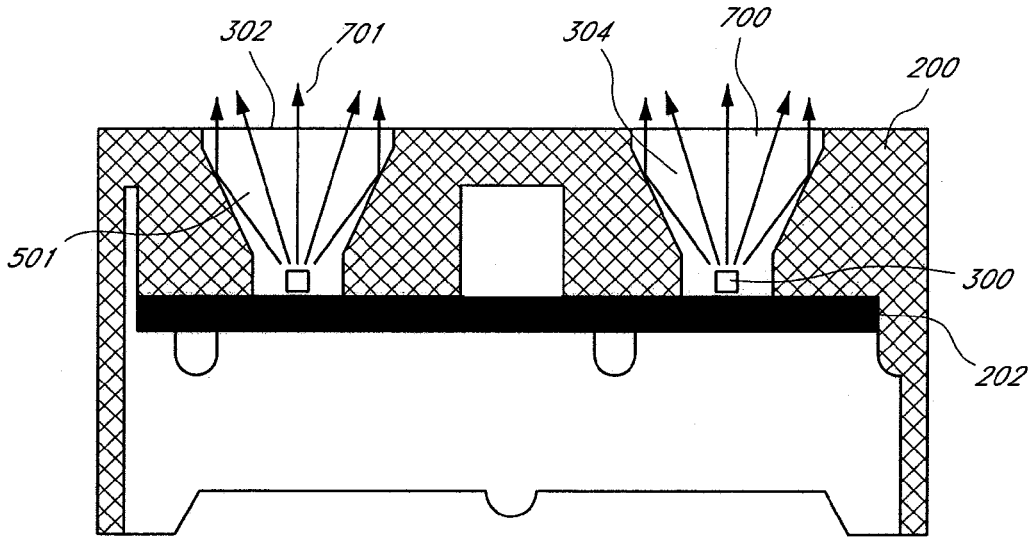
FIG. 7B
(prior art)

FIG. 7C
(prior art)
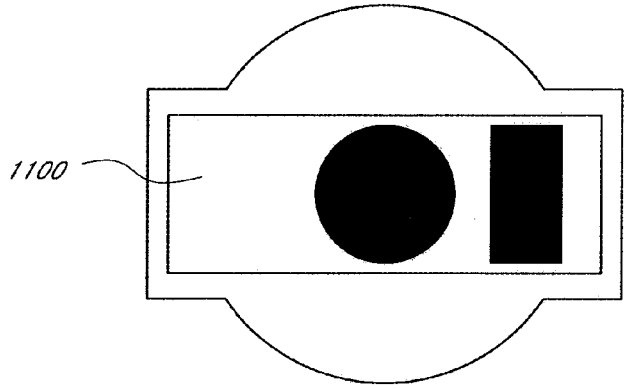
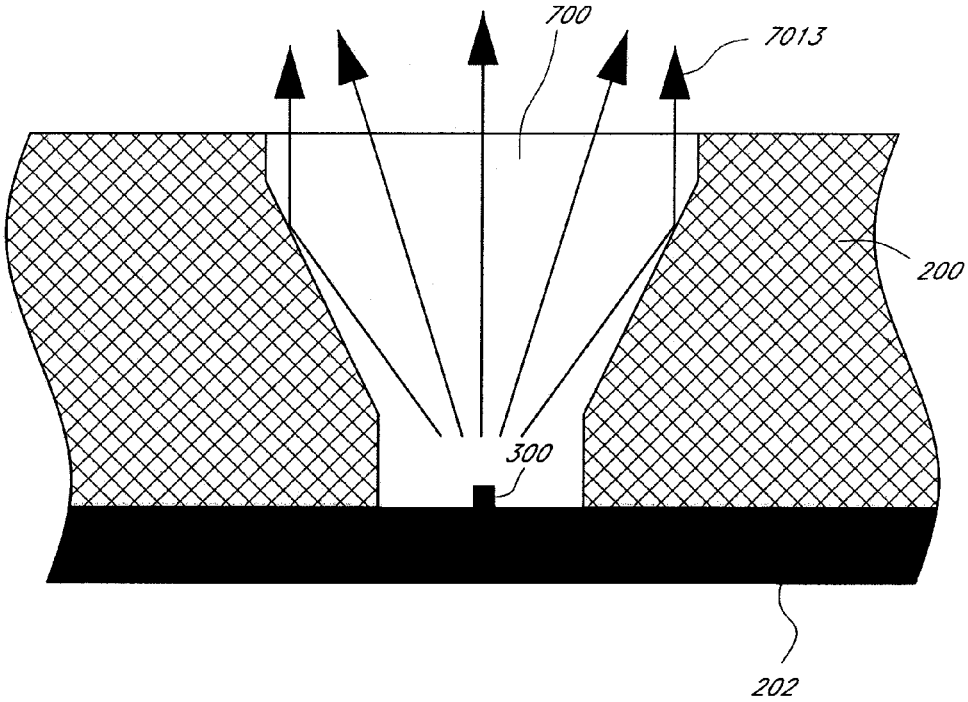
FIG. 7D
(prior art)

FIG. 11A
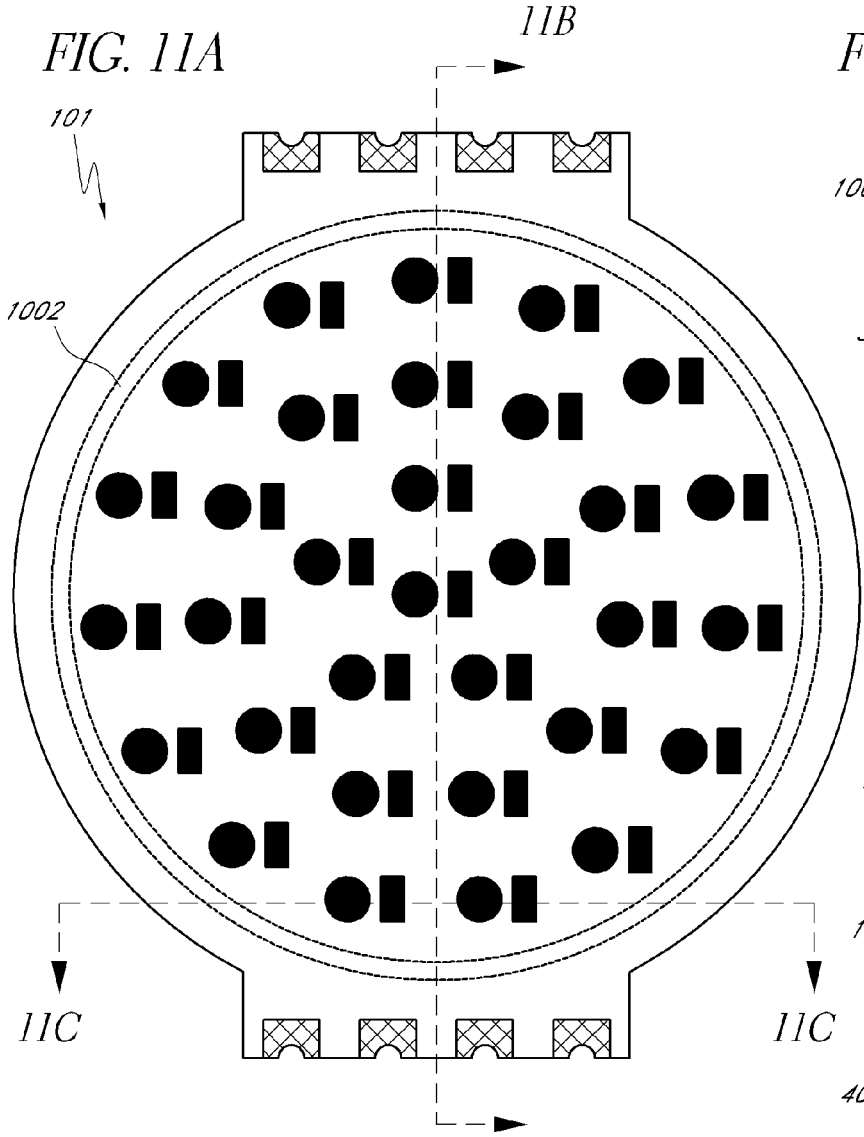
FIG. 11B
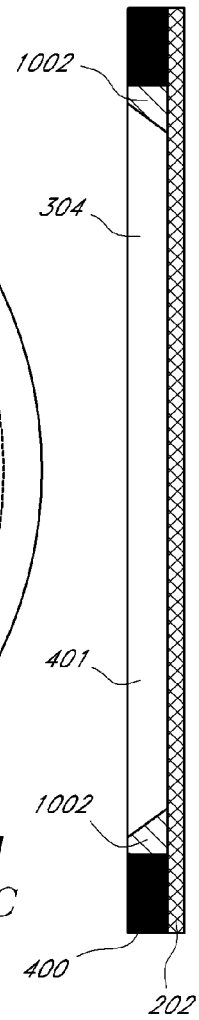
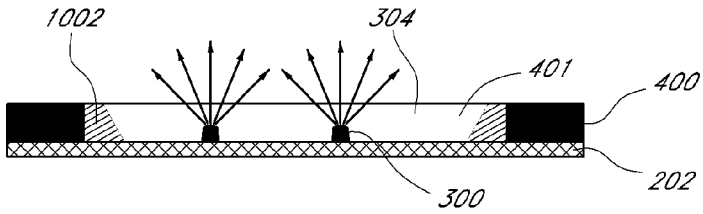
FIG. 11C

LIGHT EMITTING DIODE DISPLAY

RELATED APPLICATIONS

The present application is a continuation of U.S. patent application Ser. No. 12/269,846, filed on Nov. 12, 2008, now U.S. Pat. No. 8,136,960, the disclosure of which is incorporated herein by reference in its entirety.

BACKGROUND OF THE INVENTION

1. Field of the Invention

The present invention relates to light emitting diode (LED) displays. In particular, the present invention relates to surface mounted light emitting diodes with illuminated segments.

2. Description of the Related Art

Light emitting diodes (LEDs) are commonly used in display devices. LED displays typically have segments that are illuminated with one or more LED chips to display information. Digital characters can be divided into seven segments, and the luminescence of different segments can be combined to display different numerical values. LED displays are commonly used on control panels such as appliance controls for ovens, microwaves, dishwashers, and etc.

A typical problem with LED displays is to distribute the light emitted by the small LED chip over the entire segment to be displayed. The area of a light emitting region of an LED chip is usually less than 1 $mm^2$ while the area of the segment to be illuminated is usually more than 1 $mm^2$. In many applications, the segment shape is not the same shape as the LED chip. For example, a rectangle segment has a larger length than width while typical LED chip is circular or square. The result is often a segment with non-uniform illumination. The area of the segment directly above the LED chip usually has a greater illumination than the rest of the segment. A greater illumination in one area is often referred to as a "hot spot." Common solutions to produce a more uniform display involve using multiple LED chips within one segment or using a diffusion layer above the LED chip to scatter the light. However, using multiple LED chips in one segment increases the complexity and cost than using only one LED chip. On the other hand, using a diffusion layer to scatter the light tends to be more economical. However, if a diffusion layer is used, the distance between the LED chip and the light exit surface of the segment is relatively large to produce enough diffraction of the light to uniformly illuminate the segment.

An LED device is often mounted to a front support plate to form an LED display. The front support plate can be a printed circuit board (PCB). If a diffusion layer is used, the thickness of the PCB is determined by the distance between the LED chip and the light exit surface of the segment. The distance between the LED chip and the light exit surface is typically greater than necessary for the thickness of a PCB without an LED device. The distance for substantial uniform illumination adds to both the total thickness of the LED display and the cost of the PCB. In addition, the PCB often covers substantially the entire control panel on an appliance while the LED display is only a small portion of control panel. Therefore, the entire PCB thickness is increased due to the LED display.

SUMMARY OF THE INVENTION

These and other problems are solved by providing an LED display that uses a thinner front support plate than prior art systems. Advantageously, such an LED display has a lower cost and a smaller thickness. In one embodiment, the LED display includes a second support plate between a front support plate and a back support plate. An LED chip is provided to the back support plate. The second support plate allows the front support plate to be thinner than if the second support plate was not included. The second support plate increases the distance between the LED chip and a light exit surface thereby allowing the front support plate thickness to be reduced by about the thickness of the second support plate.

In one embodiment, a second support plate allows the total thickness of an LED display to be thinner. The second support plate adds structural integrity to a back support plate. Therefore, the back support plate can be thinner. In addition, including the second support plate in the LED display, the front support plate thickness is reduced by a similar amount as the thickness of the second support plate. Therefore, the total thickness of the LED display can be reduced by a similar amount as the back support plate can be reduced.

One embodiment includes through-holes in the front support plate and the second support plate. The through-holes allow light that is emitted by the LED chip to exit out a light exit surface. One embodiment includes a light transmissive layer that substantially fills the through-holes. In one embodiment, the light transmissive layer diffuses light. In one embodiment, the light transmissive layer is shaped like a lens. In one embodiment, the distance between the LED chip and the light exit surface is large enough so that the light emitted from the light exit surface is substantially uniform. One embodiment includes multiple light transmissive layers. In one embodiment, a light transmissive layer is opaque, semiopaque, frosty, clear, transparent, semitransparent, translucent, cloudy or a combination thereof.

One embodiment includes a light transmissive panel provided to the front support plate. The light transmissive panel can add structural support and aesthetic appearance to the LED display. In one embodiment, the light transmissive panel is a glass, polymer, and/or other light transmissive or translucent material.

In one embodiment, a reflective layer can be used to increase the amount of light that exits the light exit surface. One embodiment includes a reflective layer provided to the interior surface of the front support plate through-hole. One embodiment includes a reflective layer provided to the interior surface of the second support plate through-hole. One embodiment includes a reflective layer provided to the interface between the second support plate and the light transmissive layer. One embodiment includes a reflective layer provided to the interface between the back support plate and the light transmissive layer. In one embodiment, the reflective layer can be white material, metal film, or any material that reflects the light produced by the LED chip.

One embodiment includes a method of manufacturing an LED display. One embodiment includes forming the through-holes by drilling, machining, or etc. One embodiment includes providing the front support plate, the second support plate and the back support plate followed by forming the through-holes in the front support plate and the second support plate in one step. One embodiment includes providing the front support plate and the back support plate without a second support plate followed by forming the through-hole in the front support plate and forming a hole partially in the back support plate. The back support plate with a hole partially through the thickness creates a quasi second support plate. The portion of the back support plate with a hole forms the second support plate.

BRIEF DESCRIPTION OF THE DRAWINGS

FIGS. 7A-D illustrate a conventional LED display with multiple segments arranged to form digital characters.

FIGS. 11A-E illustrate one embodiment of an LED display device with multiple LEDs within a segment.

DETAILED DESCRIPTION OF THE PREFERRED EMBODIMENT

Figure 1:
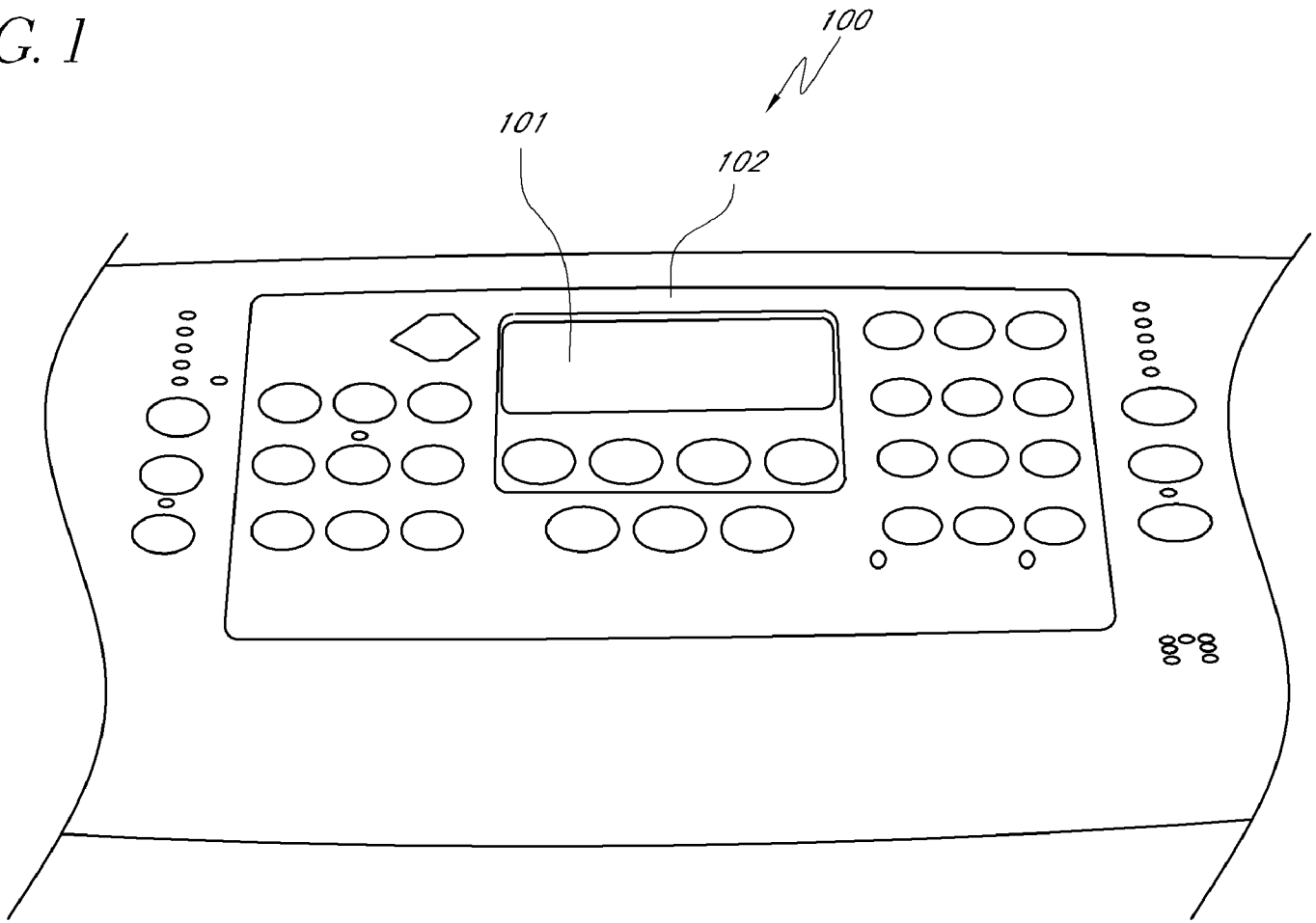
FIG. 1 illustrates a front view of one embodiment of an LED display on a control panel.
Figure 12:
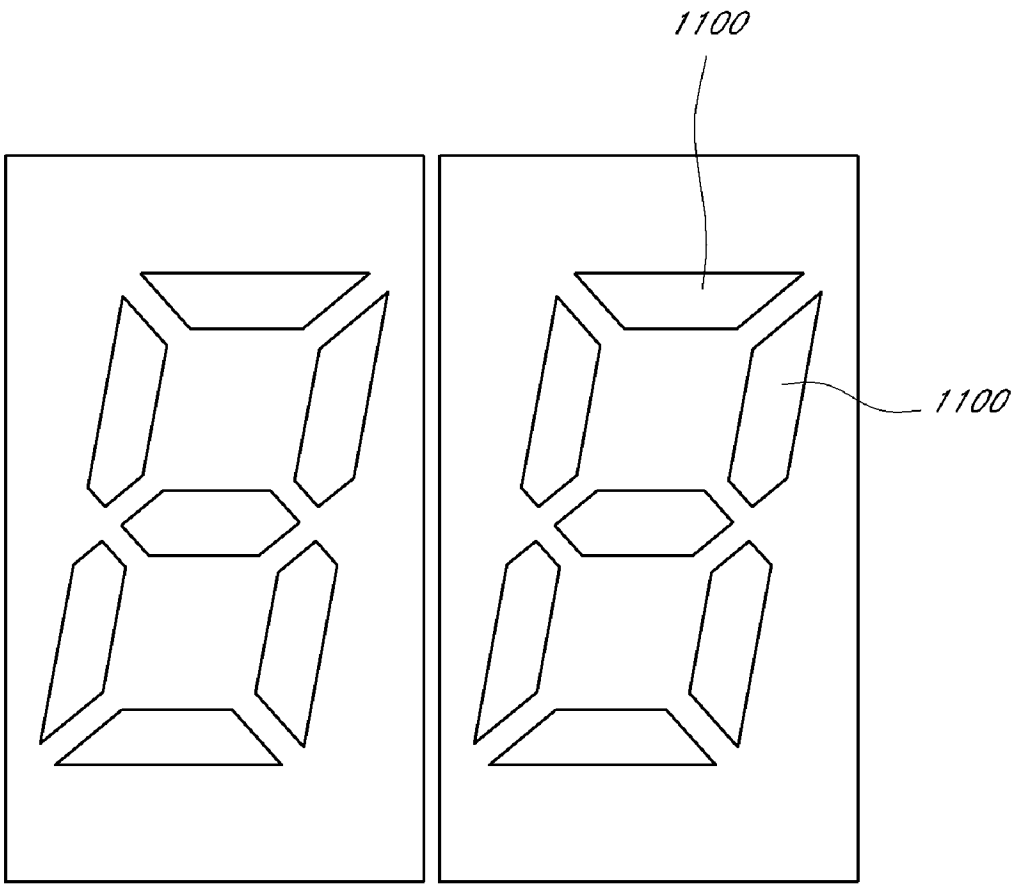
FIG. 12 illustrates one embodiment of a seven-segment LED display.

FIG. 1 illustrates one embodiment of a control panel 100 with an LED display 101. The LED display 101 emits light from the front of the control panel 100. A light transmissive panel 102 can cover the LED display 101. Advantageously, the light transmissive panel 102 can help to protect the LED display 101 from damage. The light transmissive panel can include a glass, polymer or other light transmissive material. The LED display 101 can include of a single LED segment 1100 or of a plurality of LED segments 1100. For example, a plurality of LED segments 1100 can combine to form digital characters as illustrated in FIG. 12.

Figure 2:
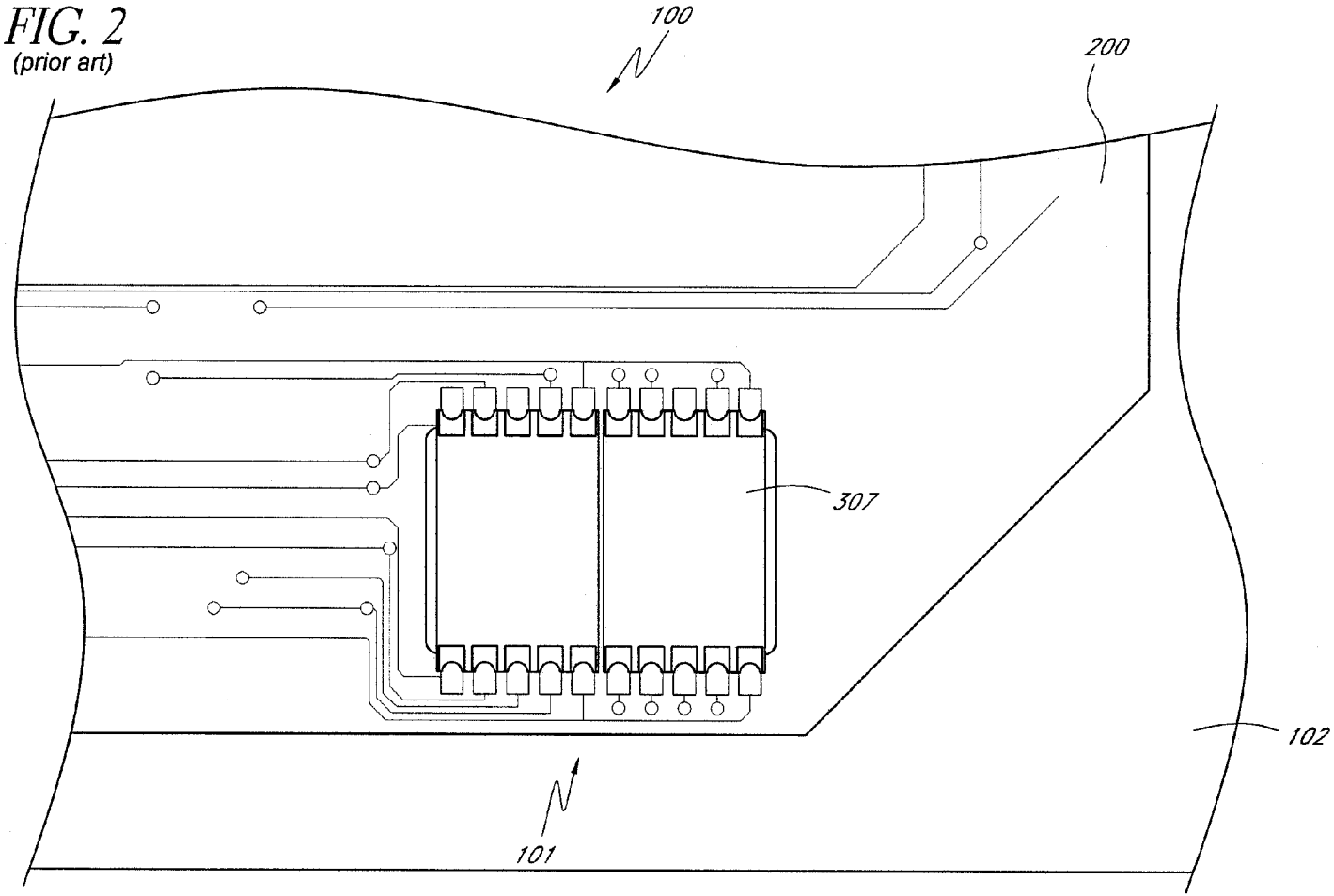
FIG. 2 (prior art)
FIG. 2 illustrates a back view of a conventional LED display on a control panel.

FIG. 2 illustrates an example of a conventional LED display 101 on the back of a control panel 100. A front support plate 200 is provided to a transmissive panel 102 and an LED device 307 is provided to the front support plate 200. The front support plate 200 can include a PCB, prepreg material, etc. The front support plate 200 and the LED device 307 add to the total thickness of the control panel 100. Advantageously, the control panel 100 is relatively thin in order to occupy less space in a device such as an appliance.

Figure 3:
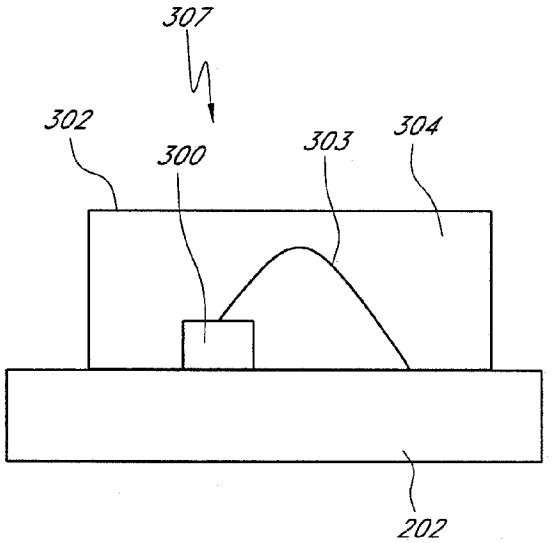
FIG. 3 (prior art)
FIG. 3 illustrates a conventional LED device.

FIG. 3 illustrates a conventional LED device 307 that can be used in an LED display 101. The LED device 307 includes an LED chip 300 provided to a back support plate 202, and a light transmissive layer 304 provided to the back support plate 202 that covers the LED chip 300. A wire 303 can be connected to the LED chip 300 to supply electricity to the LED chip 300. The light transmissive layer 304 can be a material that diffuses light 701 emitted by the LED chip 300. The distance between the LED chip 300 and a light exit surface 302 is large enough for sufficient diffusion of light to result in substantial uniform illumination on the light exit surface 302. In some embodiments, the distance is about 0 to 5 mm in order to have substantial uniform illumination.

The distance for substantial uniform illumination between the LED chip 300 and the light exit surface 302 also depends on the size and shape of a segment 1100 and location of the LED chip 300 within the segment 1100. A segment 1100 with a larger light exit surface 302 usually uses a larger distance for substantial uniform illumination. Likewise, a segment 1100 with a more complex shape uses a larger distance for substantial uniform illumination. In addition, an LED chip 300 located off-center to the display segment 1100 uses a larger distance for substantial uniform illumination. The distance can also depend on the ability of the light transmissive layer 304 to diffuse the light 701 emitted by the LED chip 300. A light transmissive layer 304 that diffuses light more may be able to have a smaller distance than a light transmissive layer 304 that diffuses light less. However, generally, when the light transmissive layer 304 diffuses light more, less light 701 emitted by the LED chip 300 escapes the light exit surface 302. Therefore, even though the distance can be decreased by using a light transmissive layer 304 that diffuses light more, a more powerful LED chip 300 would be needed to produce the same amount of light 701 that escapes the light exit surface 302.

Figure 4:
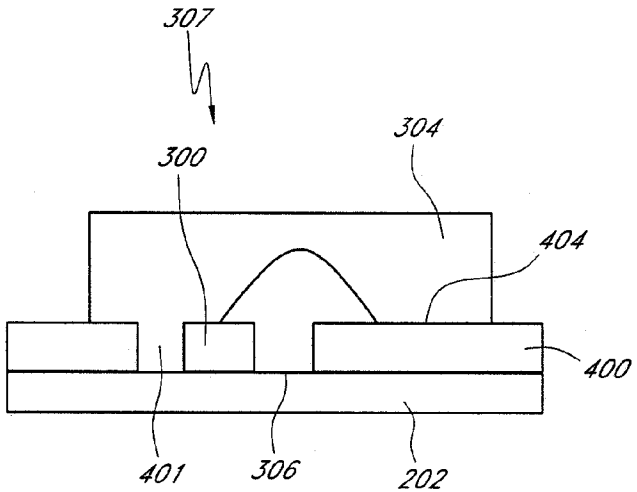
FIG. 4 illustrates one embodiment of an LED device.

FIG. 4 illustrates one embodiment of an LED device 307 that includes an LED chip 300 provided to a back support plate 202, and a second support plate 400 provided to the back support plate 202. The second support plate 400 has a through-hole 401 of sufficient size and shape to accommodate the LED chip 300. A light transmissive layer 304 is provided to the second support plate 400 and covers the LED chip 300. As illustrated in FIG. 4, the light transmissive layer 304 can fill the through-hole 401 and surround the LED chip 300. In one embodiment, the light transmissive layer 304 diffuses light. In another embodiment, the light transmissive layer 304 can be a material that diffuses light 701 emitted by the LED chip 300. However, other options to diffuse the light can be used. In one embodiment, the light transmissive layer 304 can be shaped like a lens. In another embodiment, the light transmissive layer 700 includes multiple layers. In a further embodiment, the light transmissive layer 304 can be opaque, semiopaque, frosty, clear, transparent, semitransparent, translucent, cloudy or a combination thereof. In other embodiments, the light transmissive layer 304 can have light transmissive properties graded in the layer. In one embodiment, the LED device 307 has the light transmissive layer 304 including air or a void. In some embodiments, the distance between the LED chip 300 and a light exit surface 302 is about 0 to 5 mm in order to have substantial uniform illumination.

As illustrated in FIG. 3 and FIG. 4, the distance 301 between the LED chip 300 and the light exit surface 302 is about the same for the conventional LED device 307 without a second support plate 400 in FIG. 3 and the LED device 307 with a second support plate 400 in FIG. 4. In addition, the distance between the top surface 306 of the back support plate 202 and the light exit surface 302 is about the same. On the other hand, the distance between the top surface 306 of the back support plate 202 and the light exit surface 302 is greater than the distance between the top surface 404 of the second support plate 400 and the light exit surface 302.

Figure 5:
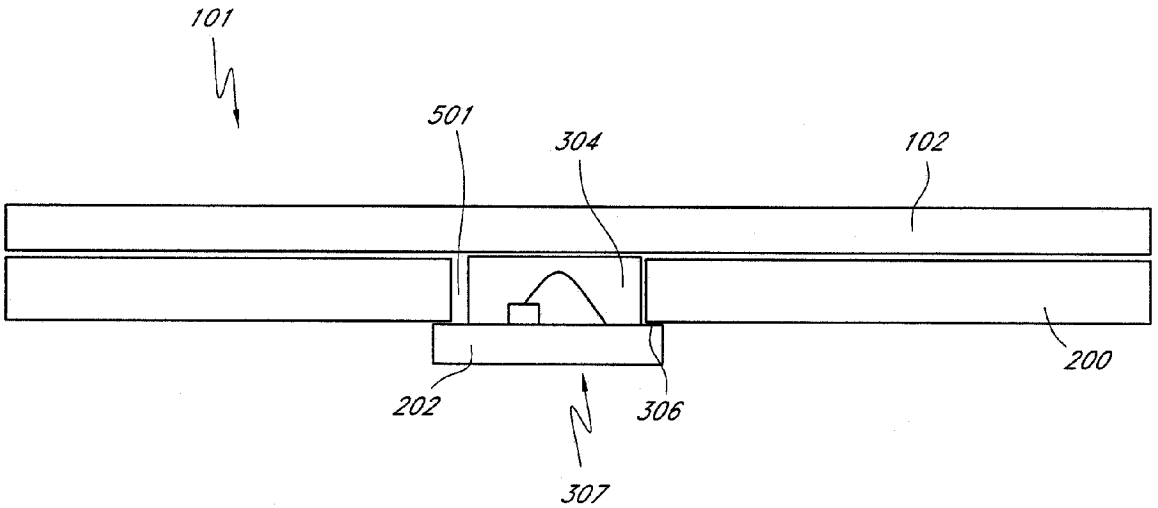
FIG. 5 (prior art)
FIG. 5 illustrates a conventional LED display including an LED device provided to a front support plate.
Figure 6:
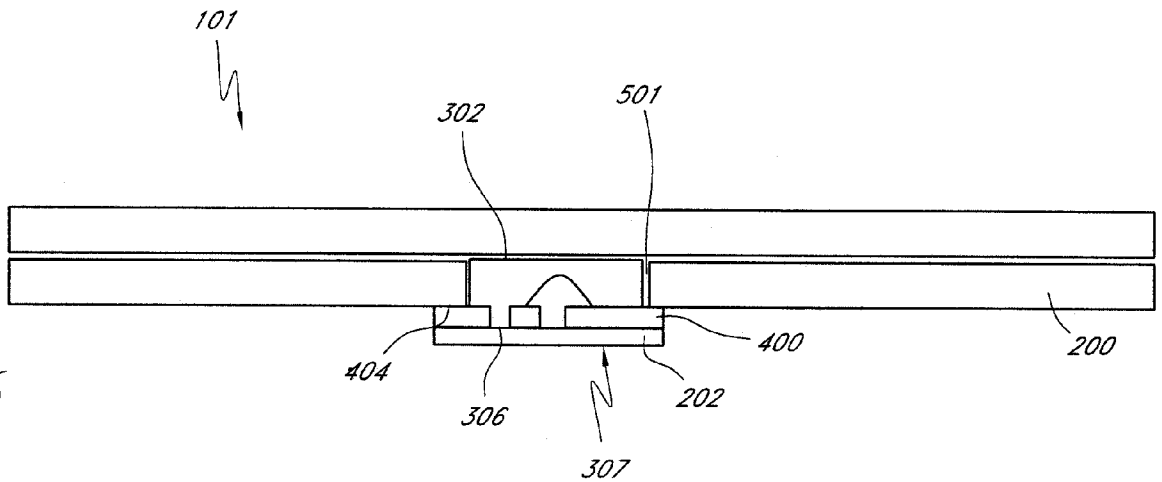
FIG. 6 illustrates one embodiment of an LED display including an LED device provided to a front support plate.

Although the second support plate 400 includes a through-hole 401, the second support plate 400 adds to the structural integrity of the back support plate 202. Therefore, the thickness of the back support plate 202 can be less for an LED device 307 with a second support plate 400 than for an LED device 307 without the second support plate 400. Generally, to maintain structural integrity of the LED device 307, the thickness of the back support plate without the second support plate 400 can be about the same as that of the combined thickness of the thickness of the back support plate 202 and thickness of the second support plate 400. Therefore, a control panel 100 with an LED device 307 with a second support plate 400 does not have to be thicker than a control panel 100 with an LED device without a second support plate 400. FIG. 5 and FIG. 6 further illustrate the advantage of an LED display 101 with a second support plate 400.

FIG. 5 illustrates an LED display 101 including a conventional LED device 307 provided to a front support plate 200 with a through-hole 501. The light transmissive layer 304 of the LED device 307 substantially fills the through-hole 501 of the front support plate 200, and a portion of the top surface 306 of the back support plate 202 is provided to the front support plate 200. A light transmissive panel 102 can also be provided to the front support plate 200. The thickness of the front support plate 200 is about the same as the thickness of the light transmissive layer 304. Therefore, the thickness of the front support plate 200 is dependent on the thickness of the light transmissive layer 304. Since the thickness of the light transmissive layer 304 is relatively large to result in substantial uniform illumination, the front support plate board 200 is relatively thicker than for a control panel 100 without an LED display 101.

FIG. 6 illustrates one embodiment of an LED display 101 with a second support plate 400. The LED display 101 includes an LED device 307 provided to a front support plate 200 with a through-hole 501. A light transmissive layer 304 of the LED device substantially fills the through-hole 501 of the front support plate 200. A portion of the top surface 404 of the second support plate 400 is provided to the front support plate 200. A light transmissive panel 102 can also be provided to the front support plate 200. The distance between the top surface 404 of the second support plate 400 and the light exit surface 302 is less than the distance between the top surface 306 of the back support plate 202 and the light exit surface 302. The thickness of the front support plate 200 is dependent on the distance between the second support plate 400 and the exit light surface 302 for an LED display 101 with a second support plate 400. On the other hand, for an LED display 101 without a second support plate 400, the thickness of the front support plate 200 is dependent on the distance between the top surface 306 of the back support plate 202 and the light exit surface 302. Therefore, the front support plate 200 can be thinner for an LED display 101 with a second support plate 400 than an LED display 101 without a second support plate 400. In addition, a thinner front support plate 200 is less expensive than a thicker front support plate 200; therefore, an LED display 101 with a second support plate 400 can be less expensive than an LED display 101 without a second support plate 400. Furthermore, the total thickness of an LED display 101 with a second support plate 400 can be less than an LED display without a second support plate 400. The thickness of the front support plate 200 is less for an LED display 101 with a second support plate 400. In addition, the total thickness of the back support plate 202 and the second support plate 400 for an LED display 101 with a second support plate 400 can be about the same as the thickness of the back support plate 202 for an LED display 101 without a second support plate. Therefore, an LED display 101 with a second support plate 400 can be advantageously used in applications requiring a thinner LED display 101 and at a reduced cost.

In one embodiment, an LED display 101 can further include a reflective layer. A reflective layer can be provided to the walls of the through-hole 501 of the front support plate 200, the walls of the through-hole 401 of the second support plate 400, the surface 306 of the back support plate 202, and/or the surface 404 of the second support plate 400. The reflective surface can be any material that reflects the light 701 emitted by the LED chip 300. For example, the reflective layer can include a white material, metal film, etc.

FIGS. 7A-D illustrate a conventional LED display 101 with multiple segments 1100. FIGS. 7A-D illustrate a two seven-segment LED displays 101. Individual segments 1100 can be selectively illuminated to display up to two digital characters. FIG. 7A illustrates a top view of the LED display 101, FIG. 7B illustrates a cross-sectional view of the LED display 101, FIG. 7C illustrates an individual segment 1100 from FIG. 7A, and FIG. 7D illustrates an individual segment 1100 from FIG. 7B. As illustrated by FIGS. 7A-D, an LED chip 300 is mounted to a back support plate 202, and a front support plate 200 is provided to the back support plate 202. The front support plate 200 includes through-holes 501 with both a size and shape to accommodate the LED chip 300 and light exit surface 302 with a desired size and shape. As discussed before for conventional LED displays 101, thickness of the front support plate 200 is dependent on the distance between the LED chip 300 and the light exit surface 302.

Figure 8B:
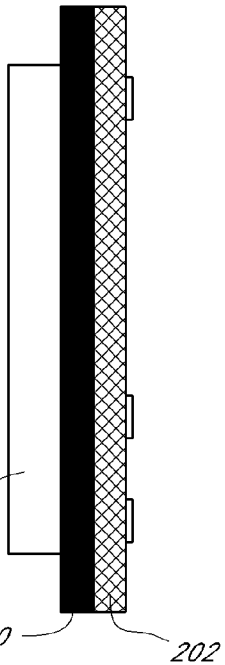
FIGS. 8A-E illustrate one embodiment of an LED display with multiple segments arranged to form digital characters.
Figure 8A:
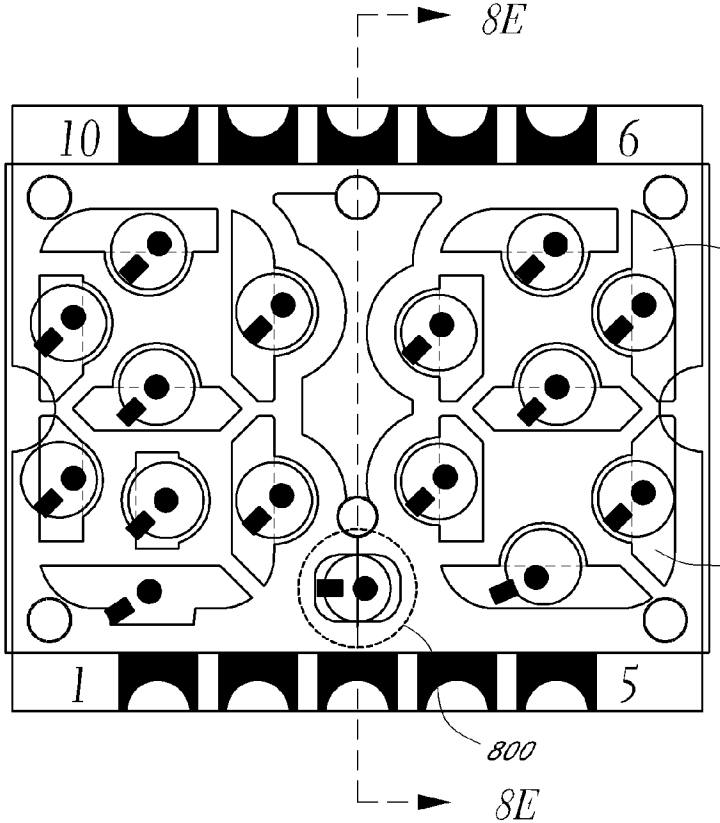
Figure 8C:
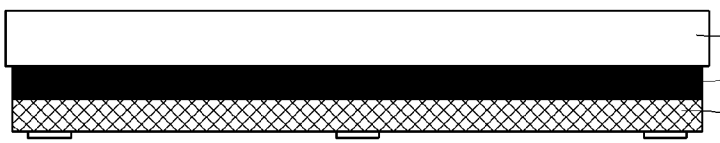
Figure 8D:
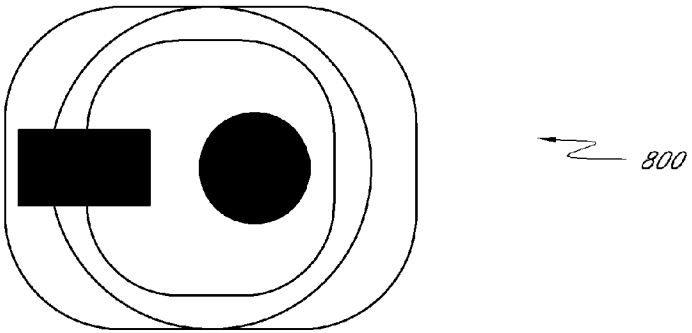
Figure 8E:
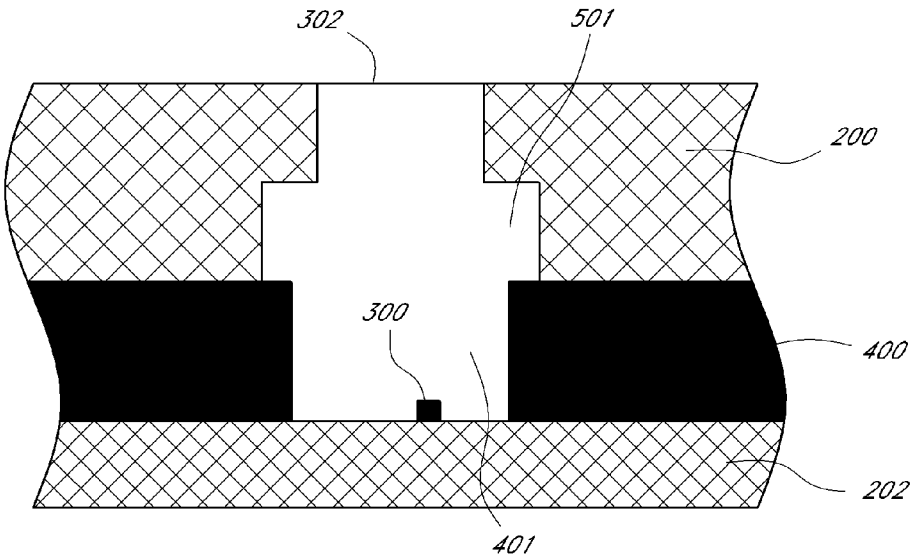
Figure 9B:
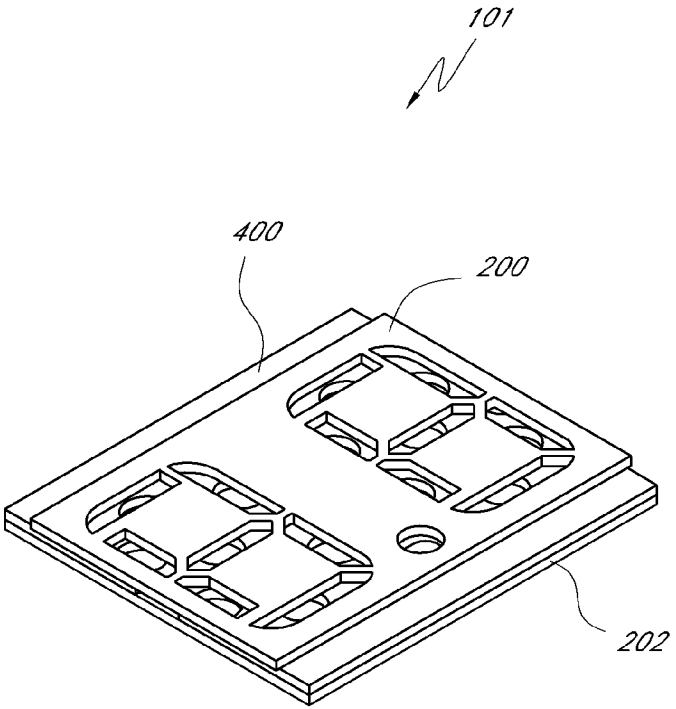
FIGS. 9A-B illustrate one embodiment of an LED display with multiple segments arranged to form digital characters.
Figure 9A:
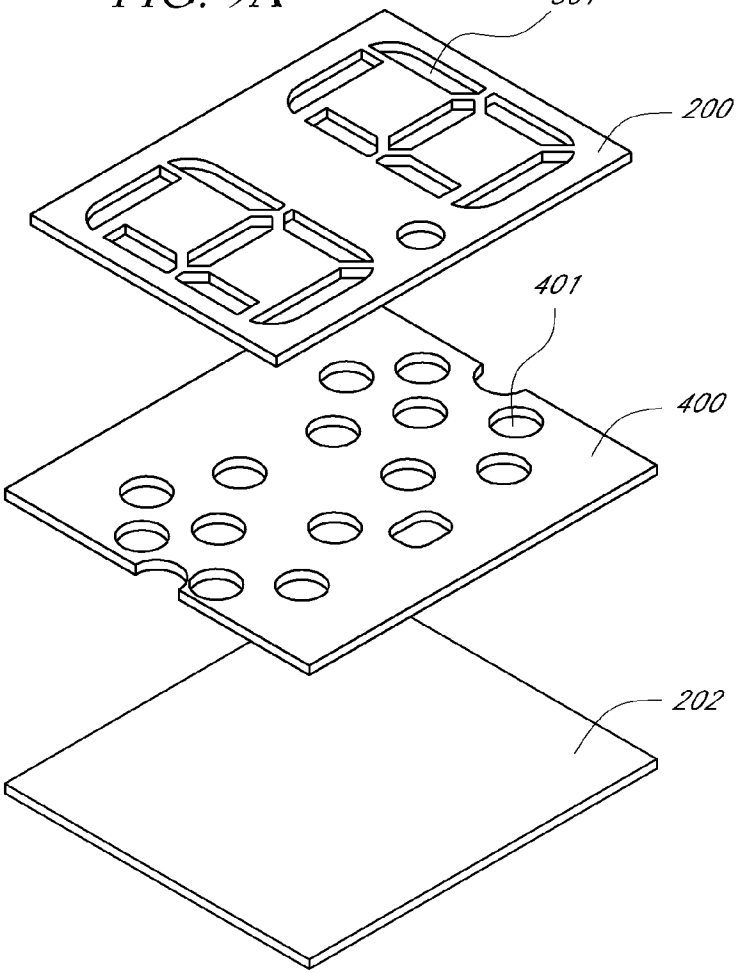

FIGS. 8A-E and FIGS. 9A-B illustrate one embodiment of an LED display 101 with a second support plate 400. FIGS. 8A-E and FIGS. 9A-B illustrate a two seven-segment LED display 101 including individual segments 1100 that can be selectively illuminated to display up to two digital characters. FIG. 8A illustrates a top view of the LED display 101, and FIG. 8B and FIG. 8C illustrate two side views of the LED display 101 which are perpendicular to each other. The side view in FIGS. 8B and 8C illustrate a back support plate 202 provided to a second support plate 400 and the second support plate 400 provided to a front support plate 200. FIG. 8D illustrates area 800 of the LED display 101, and FIG. 8E illustrates a cross-sectional of FIG. 8D. The cross-sectional view in FIG. 8E is of a segment 1100 that can be selectively illuminated to represent a decimal point in the two seven-segment LED display 101. FIG. 9A illustrates a front support plate 200, a back support plate 202 and a second support plate 400 while FIG. 9B illustrates an assembled LED display 101. The three plates are stacked with the second support plate 400 between the front support plate 200 and the back support plate 202. The LED display 101 includes an LED chip 300 provided to the back support plate 202. The front support plate 200 can be a reflective material to increase the amount of light 701 emitted by the LED chip 300 to exit the light exit surface 302. The second support plate 400 includes a through-hole 401 for the LED chip 300 to reside. The front support plate 200 also has a through-hole 501 connected to the through-hole 401 of the second support plate 400. Size and shape of the second support plate through-hole 401 and the front support plate through-hole 501 may not be the same. In addition, size and shape may vary through the second support plate through-hole 401. Similarly, the size and shape may vary through the front support plate through-hole 501. For example, as illustrated in FIG. 8E, the front support plate 200 includes a front support plate through-hole 501 that includes two different diameters. The size and shape of the front support plate through-hole 401 and the second support plate through-hole 401 can be designed so that a desired segment shape and a substantial uniform illumination across the segment shape can be achieved.

There are advantages to the LED displays 101 illustrated in FIGS. 6, 8A-E and 9A-B when compared to the LED displays 101 illustrated in FIGS. 5 and 7A-D. The LED displays 101 in FIGS. 6, 8A-E and 9A-B include a second support plate 400. The distance from the LED chip 300 and the light exit surface 302 is large enough to have substantial uniform illumination on the light exit surface. Therefore, an LED display 101 with a second support plate 400 can have a thinner front support plate 200. An LED display 101 with a second support plate 400 can reduce the thickness of the front support panel 200 by about the thickness of the second support plate 400. Generally, the thickness of the front support panel 200 of an LED display 101 with a second support plate 400 can be any thickness independent of the distance between the LED chip 300 and the light exit surface 302. Preferably, the thickness of the front support panel 200 of an LED display 101 with a second support plate 400 is less than about 5 mm. More preferably, the thickness of the front support panel 200 of an LED display 101 with a second support plate 400 is less than about 2 mm. Most preferably, the thickness of the front support panel 200 of an LED display 101 with a second support plate 400 is less than about 1 mm.

Discussed next are illustrative examples comparing some embodiments of an LED display 101 with a second support plate 400 to LED displays 101 without a second support plate 400. The first example compares LED displays including a distance between the LED chip 300 and the light exit surface of about 2 mm. For an LED display 101 without a second support plate 400, the thickness of the front support plate 200 is about 2 mm. For an LED display 101 with a second support plate 400, the thickness of a second support plate 400 can be about 1 mm while a thickness of a front support panel 200 can be about 1 mm. Therefore, the thickness of the front support panel 200 is about fifty percent that of an LED display 101 without a second support plate 400. The second example compares LED displays including a distance between the LED chip 300 and the light exit surface of about 5 mm, and also illustrates the increased benefits of an LED display 101 with a second support plate 400 as the distance between the LED chip 300 and the light exit surface increases. For an LED display 101 without a second support plate 400, the thickness of the front support plate 200 is about 5 mm. For an LED display 101 with a second support plate 400, the thickness of a second support plate 400 can be about 4 mm while a thickness of a front support panel 200 can be about 1 mm. Therefore, the thickness of the front support panel 200 is about twenty percent that of an LED display 101 without a second support plate 400. This illustrates that the thickness of the front support panel 200 can remain relatively thin even if the distance between the LED chip 300 and the light exit surface is relatively large. Therefore, as the distance for substantial uniform illumination between an LED chip 300 and a light exit surface 302 increases, the cost savings of using a second support plate 400 in an LED display 101 increases.

Moreover, a total thickness of an LED display 101 with a second support plate 400 can actually be less than that of a similar LED display 101 without a second support plate 400. A second support plate 400 adds structural integrity to the LED display 101. Therefore, the thickness of the back support plate 202 can be reduced as well. Following is an example to illustrate the reduced thickness of an LED display 101 with a second support plate 400. For example, if the thickness of the back support plate 202 is about 2 mm without a second support plate 400, the thickness of the back support plate 202 with a second support plate can be reduced, for example, to 1 mm. Therefore, in this example, the total thickness of an LED display 101 with a second support plate 400 is about 1 mm less than the total thickness of an LED display 101 without a second support plate 400.

Figure 10B:
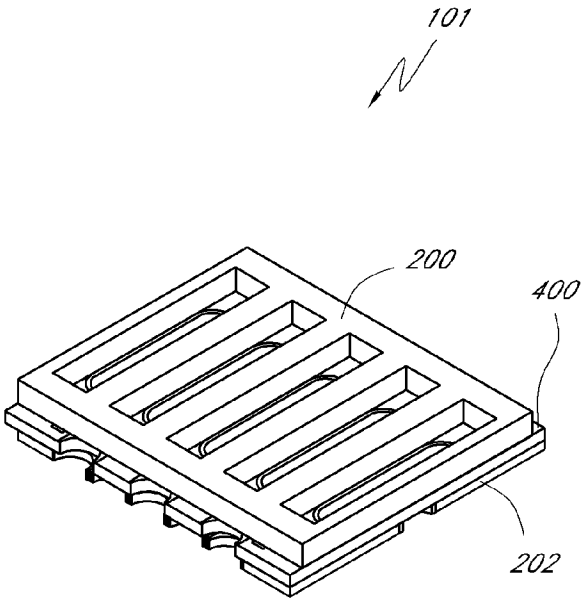
FIGS. 10A-B illustrate one embodiment of an LED display with five segments.
Figure 10A:
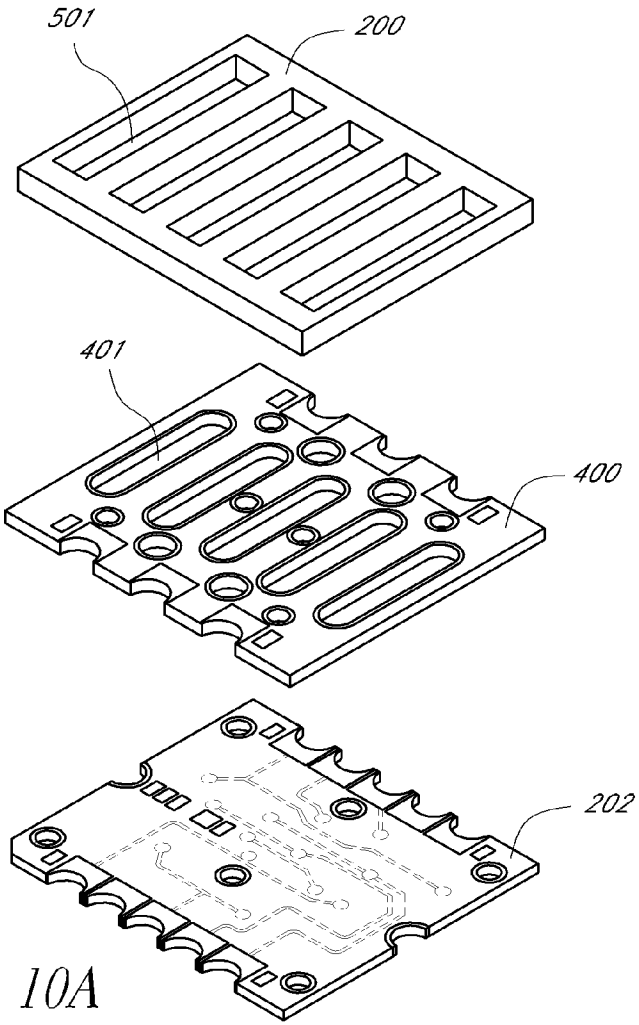

FIGS. 10A-B illustrate one embodiment of an LED display 101 with five segments 1100. FIG. 10A illustrates a front support plate 200, a back support plate 202 and a second support plate 400 while FIG. 10B illustrates an assembled LED display 101. The back support plate 202 in FIG. 10A includes a dashed circuit pattern to illustrate that the back support plate 202 can be a printed circuit board, but the dashed circuit pattern is not intended to show a specific circuit. The three plates are stacked with the second support plate 400 between the front support plate 200 and the back support plate 202. The back support plate 202 has LED chips 300 provided. The second support plate 400 is provided to the back support plate 202 and includes through-holes 401 above the LED chips 300. The front support plate 200 is provided to the second support plate 400 and includes through-holes 501. The front support plate through-holes 501 are connected to the second support plate through-holes 401. The front support plate through-holes 501 and second support plate through-holes 401 are substantially filled with a light transmissive layer 304. Light emitted by the LED chip 300 exits at an exit light surface 302. The distance between the LED chip 300 and the exit light surface 302 is sufficient in order for the exit light surface 302 of each segment 1100 to produce substantially uniform illumination when the LED chip 300 is activated.

Figure 11D:
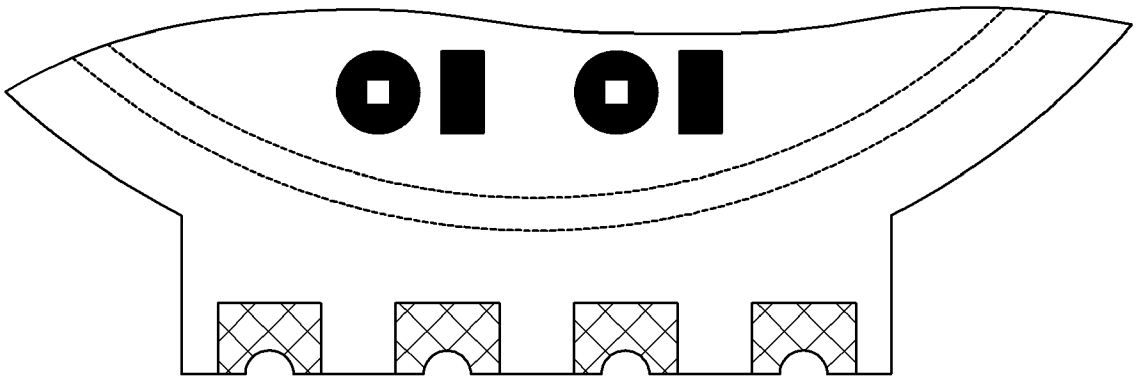
Figure 11E:
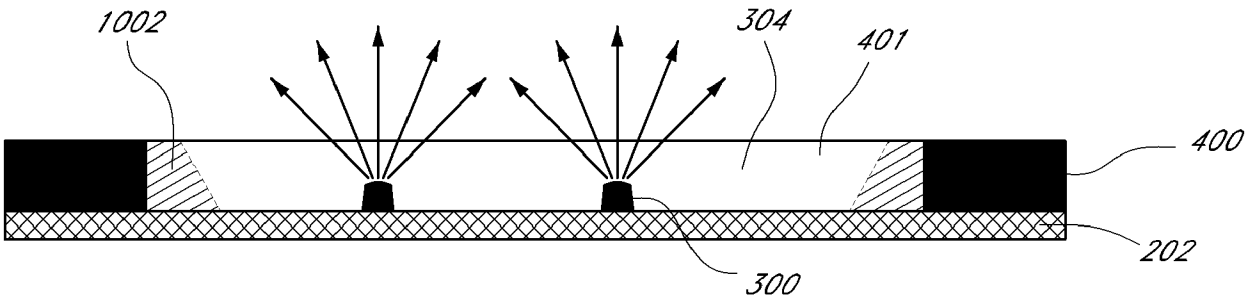

FIGS. 11A-E illustrate one embodiment of an LED display 101 that includes more than one LED chip 300 within a single segment 1100. FIG. 11A illustrates a top view of the LED display 101 along with cross-sectional views A-A and B-B in FIG. 11B and FIG. 11C, respectively. FIG. 11D illustrates an enlarged top view of FIG. 11A, and FIG. 11E illustrates a B-B cross-section view. An LED chip 300 is provided to a back support plate 202. The back support plate 202 is provided to a second support plate 400. The second support plate 400 includes a through-hole 401 wherein the LED chips 300 reside. A reflector 1002 can be provided to the interior walls of the through-hole 401 of the second support plate 400. The through-hole 401 can be substantially filled with a light transmissive layer 304. The light transmissive layer 304 can be a material that diffuses light. The second support plate 400 can also be provided to a front support plate 200 or a light transmissive panel 102. If a front support plate 200 is provided to the second support plate 400, a light transmissive panel 102 can be provided to the front support plate 200.

An LED display 101 with a second support plate 400 can be manufactured in a number of methods. In one embodiment, an LED chip 300 is provided to a back support plate 202. A through-hole 401 is formed in a second support plate 400. The through-hole 401 can be formed by methods including drilling, punching, machining, or etc. The second support plate 400 is provided to the back support plate 202. The second support plate 400 and the back support plate 202 can be provided by methods including adhesives, glues, or etc. A through-hole 501 is formed in a front support plate 200. The through-hole 501 can be formed by methods including drilling, punching, machining, or etc. A portion of the second support plate 400 is provided to a front support plate 200. In a further embodiment, a light transmissive layer 304 is provided into the through-hole 401 of the second support plate 400 and the through-hole 501 of the front support plate 200. In one embodiment, the light transmissive layer 304 diffuses light. In another embodiment, the light transmissive layer 304 can be a material that diffuses light 701 emitted by the LED chip 300. However, other options to diffuse the light can be used. In one embodiment, the light transmissive layer 304 can be shaped like a lens. In another embodiment, the light transmissive layer 700 includes multiple layers. In a further embodiment, the light transmissive layer 304 can be opaque, semiopaque, frosty, clear, transparent, semitransparent, translucent, cloudy or a combination thereof. In other embodiments, the light transmissive layer 304 can have light transmissive properties graded in the layer. In one embodiment, the LED device 307 has the light transmissive layer 304 including air or a void.

In one embodiment, a through-hole 501 is formed in a front support plate 200. The front support plate 200 is provided to a light transmissive panel 102. An LED chip 300 is provided to a back support plate 202. A through-hole 401 is formed in a second support plate 400, and the second support plate 400 is provided to the back support plate 202 so that the LED chip is in the through-hole 401 of the second support plate. The through-hole 501 of the front support plate 200 is substantially filled with a light transmissive layer 304. A portion of the second support plate 400 is provided to the front support plate 200.

In one embodiment, a back support plate 202 is provided to a second support plate 400. The second support plate 400 is provided to a front support plate 200. A hole is formed through the front support plate 200 and the second support plate 400. The hole forms a through-hole 501 in the front support plate 200 and a through-hole 401 in the second support plate 400. The hole can be formed by methods including drilling, punching, machining, or etc. An LED chip 300 is provided to the back support plate 200 in the hole. In a further embodiment, a light transmissive layer 304 is provided into the through-hole 501 of the front support plate 200 and the through-hole 401 in the second support plate 400. In a further embodiment, a light transmissive panel 102 is provided to the front support plate 200.

In one embodiment, a back support plate 202 is provided to a front support plate 200 without a second support plate 400. A hole is formed through the front support plate 200 and partially though the back support plate 400. The hole forms a though hole 501 in the front support plate 200 and forms a through-hole 401 in a quasi second support plate 400. The portion of the back support plate 202 that the hole is formed in forms the second support plate 400. The portion of the back support plate 202 that the hole is not formed remains the back support plate 202. An LED chip 300 is provided to the back support plate 200 in the hole.

Although various embodiments have been described above, other embodiments will be within the skill of one of ordinary skill in the art. Thus, for example, although described primarily in terms of an LED display 101, one of ordinary skill in the art will recognize that all or part of the LED display 101 can be applied to other light emitting devices, such as, for example, lasers, field emission devices, and filament light devices, and organic LEDs. Thus, the invention is limited only by the claims that follow.

What is claimed is:

1. A light emitting display comprising:

a front support plate with a front support plate through-hole, wherein the front support plate comprises a front support plate thickness and the front support plate through-hole comprises a first shaped opening;

a second support plate with a second support plate through-hole, wherein the second support plate comprises a second support plate thickness and the second support plate through-hole comprises a second shaped opening;

wherein the second support plate is provided to the front support plate and the second support plate through-hole is connected to the front support plate through-hole;

a back support plate provided to the second support plate, wherein the back support plate comprises a back support plate thickness;

a light emitting device provided to the back support plate, wherein the light emitting device is within the second support plate through-hole;

a first light transmissive layer provided in the front support plate through-hole, wherein the first light transmissive layer comprises a first light transmissive material; and a second light transmissive layer provided in the second support plate through-hole, wherein the second light transmissive layer comprises a second light transmissive material.

2. A light emitting display comprising:

a front support plate with a front support plate through-hole, wherein the front support plate comprises a front support plate thickness and the front support plate through-hole comprises a first shaped opening;

a second support plate with a second support plate through-hole, wherein the second support plate comprises a second support plate thickness and the second support plate through-hole comprises a second shaped opening;

wherein the second support plate is provided to the front support plate and the second support plate through-hole is connected to the front support plate through-hole;

a back support plate provided to the second support plate, wherein the back support plate comprises a back support plate thickness; and a light emitting device provided to the back support plate, wherein the light emitting device is within the second support plate through-hole.

3. A method of manufacturing a light emitting display of claim 1 comprising:

providing a front support plate with a front support plate thickness;

providing a back support plate with a back support plate thickness;

providing a second support plate with a second support plate thickness;

providing a light emitting device to the back support plate;

forming a front support plate through-hole in the front support plate wherein the front support plate through-hole comprises a first shaped opening;

forming a second support plate through-hole in the second support plate wherein the second support plate through-hole comprises a second shaped opening;

providing the back support plate to the second support plate, wherein the light emitting device is located within the second support plate through-hole;

providing the second support plate to the front support plate, wherein the front support plate through-hole is connected to the second support plate through-hole;

providing a first light transmissive layer in the front support plate through-hole, wherein the first light transmissive layer comprises a first light transmissive material; and providing a second light transmissive layer in the second support plate through-hole, wherein the second light transmissive layer comprises a second light transmissive material.

4. A method of claim 3, wherein the first light transmissive layer substantially fills the front support plate through-hole and the second light transmissive layer substantially fills the second support plate through-hole.

5. A method of claim 4, wherein the first light transmissive layer and the second light transmissive layer comprise light-diffusing material.

6. A method of claim 4, wherein the first light transmissive layer and the second light transmissive layer comprise an epoxy.

7. A method of claim 3, further comprising providing a light transmissive panel to the front support plate.

8. A method of claim 3, wherein the front support panel comprises a reflective material.

9. A method of claim 3, further comprising providing a reflective layer to an interior surface of the front support plate through-hole.

10. A method of claim 9, further comprising providing a reflective layer to an interior surface of the second support plate through-hole.

11. A method of claim 3, wherein the front support plate thickness is less than about 2 mm.

12. A method of claim 3, wherein the front support plate thickness is less than about 1 mm.

13. A method of claim 3, further comprising forming a light exit surface defined by an area of the front support panel through-hole wherein, in use, a light emitted by the light emitting device exits, and wherein, in use, the light emitted out of the light exit surface is substantially uniform.

14. A method of claim 13, wherein a distance between the light emitting device and the light exit surface is about 0 to 5 mm.

15. A method of manufacturing a light emitting display of claim 1 comprising:

providing a front support plate with a front support plate thickness;

providing a back support plate with a back support plate thickness;

providing a second support plate with a second support plate thickness;

providing a light emitting device to the back support plate;

forming a front support plate through-hole in the front support plate wherein the front support plate through-hole comprises a first shaped opening;

forming a second support plate through-hole in the second support plate wherein the second support plate through-hole comprises a second shaped opening;

providing the back support plate to the second support plate, wherein the light emitting device is located within the second support plate through-hole; and providing the second support plate to the front support plate, wherein the front support plate through-hole is connected to the second support plate through-hole.

16. A light emitting display of claim 1, wherein the first light transmissive layer substantially fills the front support plate through-hole and the second light transmissive layer substantially fills the second support plate through-hole.

17. A light emitting display of claim 1, further comprising a light transmissive panel provided to the front support plate.

18. A light emitting display of claim 1, wherein the front support plate thickness is less than about 2 mm.

19. A light emitting display of claim 1, further comprising a light exit surface, wherein a distance between the light emitting device and the light exit surface is between about 0 to 5 mm.

20. A light emitting display of claim 1, further comprising:

a plurality of front support plate through-holes;

a plurality of second support plate through-holes;

a plurality of light emitting devices; and wherein at least one light emitting device is located in each of the plurality of second support plate through-holes, and each of the plurality of second support plate through-holes is connected to at least one of the plurality of front support plate through-holes to form a plurality of segments.

* * * * *